US006540551B1

(12) United States Patent
Wang

(10) Patent No.: US 6,540,551 B1
(45) Date of Patent: Apr. 1, 2003

(54) CONNECTOR STRUCTURE

(75) Inventor: Yao Do Wang, Hsintien (TW)

(73) Assignee: Cosner Precision Electronics Co., Ltd., Taipei (TW)

( * ) Notice: Subject to any disclaimer, the term of this patent is extended or adjusted under 35 U.S.C. 154(b) by 0 days.

(21) Appl. No.: 10/002,286

(22) Filed: Dec. 5, 2001

(51) Int. Cl.[7] ..... H01R 13/60
(52) U.S. Cl. ..... 439/541.5; 439/74; 439/540.1
(58) Field of Search ..... 439/79, 541.5, 439/540.1, 357

(56) References Cited

U.S. PATENT DOCUMENTS 5,545,052 A * 8/1996 Hirai ..... 439/357
6,168,462 B1 * 1/2001 Liao ..... 439/541.5
6,183,270 B1 * 1/2001 Huang et al. ..... 439/541.5
6,200,161 B1 * 3/2001 McClinton et al. ..... 439/541.5

* cited by examiner

*Primary Examiner*—Tho D. Ta
(74) *Attorney, Agent, or Firm*—Rosenberg, Klein & Lee

(57) ABSTRACT

The present invention provides an improved connector structure, which is a double-layer connector comprising an insulating main body, an upper and a lower terminal seat, a first connector, and a second connector. The insulating main body has a first main body and a second main body. A D-type connector is installed in the first main body. Conductive terminals of the D-type connector are bent into L shapes and then embedded into the upper and lower terminal seats, which are then embedded at the rear side of the insulating main body. The AV plug connector is wholly assembled and then installed in the second main body. Several AV plug connectors are integrated on the insulating main body to facilitate insertion for use. Moreover, the whole structure is much simplified to facilitate assembly, hence greatly lowering manufacturing and processing cost.

4 Claims, 3 Drawing Sheets

CONNECTOR STRUCTURE

FIELD OF THE INVENTION

The present invention relates to an improved connector structure and, more particularly, to an improved double-layer connector structure, which is composed of a D-type connector and an audio-video (AV) plug connector. The AV plug connector is wholly assembled and then installed in a second main body. Therefore, a plurality of AV plug connectors can be integrated on an insulating main body to facilitate insertion for use. Moreover, the whole structure is much simplified to facilitate assembly, hence greatly reducing the manufacturing and processing cost.

BACKGROUND OF THE INVENTION

In the prior art, there have been various types of connectors integrated into an assembly. For instance, R.O.C. Pat. No. 323,857 and 334,185 disclosed a structure integrating connectors of different types. The structure comprises an insulating main body partitioned into a first main body and a second main body. A first connector and a second connector of different types are joined in the first main body and the second main body, respectively, thereby letting the occupied space be minimum when joined with a circuit board.

The first connector is generally a D-type connector, and the second connector is generally an audio jack connector. However, it is seldom to assemble an AV plug connector and a D-type connector together. Therefore, the AV plug connector needs to be separately soldered on a printed circuit board, resulting in inconvenience of insertion for use and occupying much space of the printed circuit board.

SUMMARY OF THE INVENTION

Accordingly, one object of the present invention is to provide an improved double-layer connector structure so as to assemble a D-type connector and an AV plug connector together for facilitating insertion for use.

Another object of the present invention is to provide an improved connector structure, which is much simplified so as to facilitate assembly of two connectors, hence greatly lowering the manufacturing and processing cost.

Yet another object of the present invention is to provide an improved double-layer connector structure capable of saving space, thereby greatly reducing the volume of the whole double-layer connector.

The present invention is characterized in that a double-layer connector comprises an insulating main body, an upper and a lower terminal seat, a D-type connector, and an AV plug connector. The insulating main body has a first main body and a second main body. The D-type connector is installed in the first main body. Conductive terminals of the D-type connector are bent into L shapes and then embedded into the upper and lower terminal seats, which are then embedded at the rear side of the insulating main body. The AV plug connector is installed in the second main body. The AV plug connector is wholly assembled and then installed in the second main body.

The present invention is also characterized in that the D-type connector has a panel body in front of the first main body at the upper layer. A penetrated hole is disposed at each side of the panel body. A metal shell is riveted at the front side of the panel body. Riveting elements are used to penetrate the panel body and the penetrated holes at two sides of the metal shell to fix the metal shell at the front side of the panel body. Moreover, conductive terminals of the D-type connector are bent into L shapes. Transversal portions of the conductive terminals as contact ends are embedded into the upper terminal seat, and straight portions of the conductive terminals as solder ends are embedded into the lower terminal seat. The upper and lower terminal seats are then embedded at the rear side of the insulating main body.

The present invention is also characterized in that the AV plug connector comprises an insulating seat, and an insertion socket is integrally formed at the front side of the insulating seat. The insertion socket has an L-shaped conductive terminal therein. One end of the conductive terminal as a contact portion is in the insertion socket, and the other end of the conductive terminal as a solder portion extends out of the insulating seat. The AV plug connector is wholly assembled and then installed in a through hole formed in the second main body. The insertion socket of the AV plug connector protrudes out of the through hole.

The various objects and advantages of the present invention will be more readily understood from the following detailed description when read in conjunction with the appended drawing, in which:

DETAILED DESCRIPTION OF THE PREFERRED EMBODIMENTS

Figure 1:
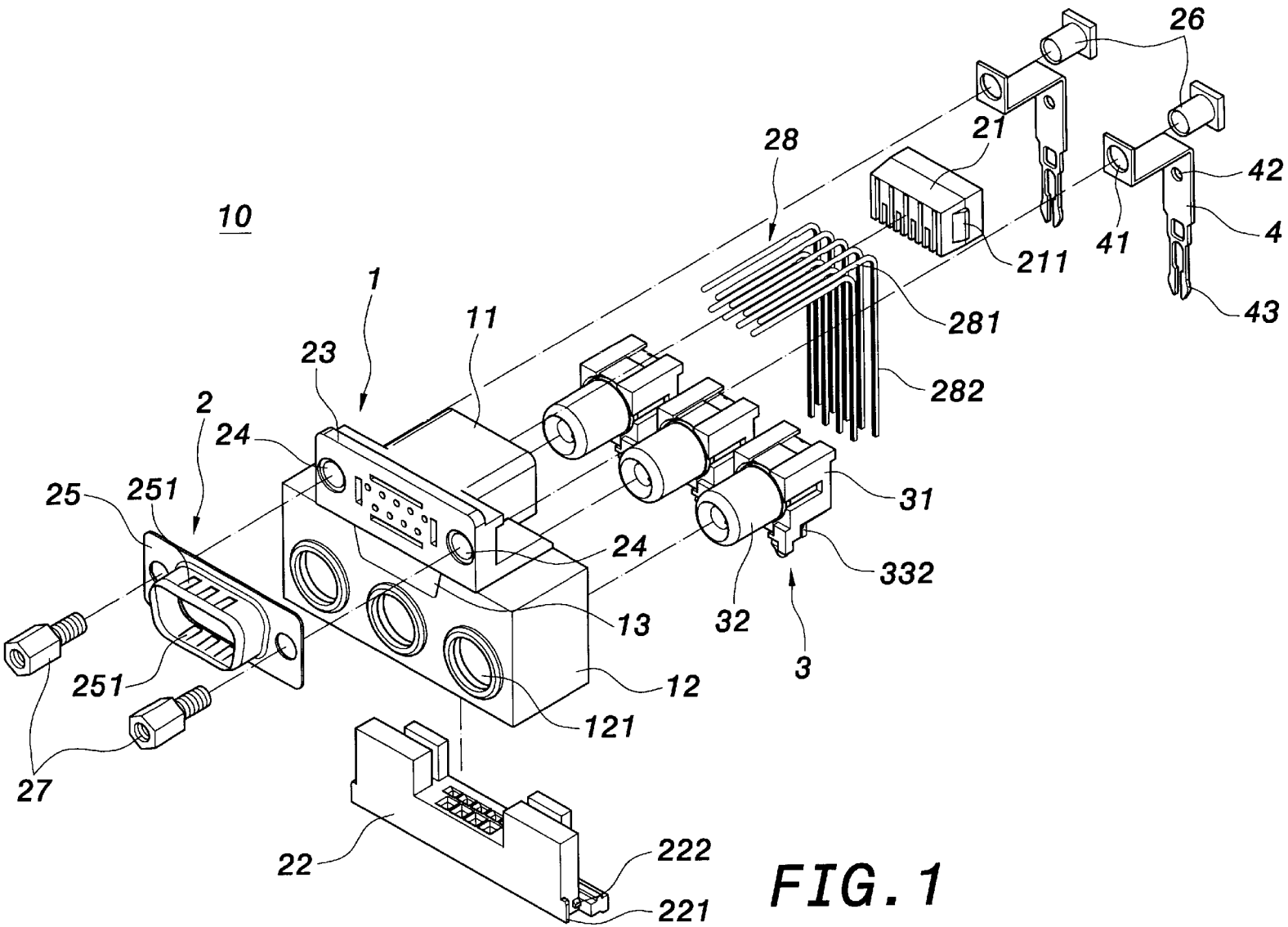
FIG. 1 is an exploded perspective view of the present invention.
Figure 2:
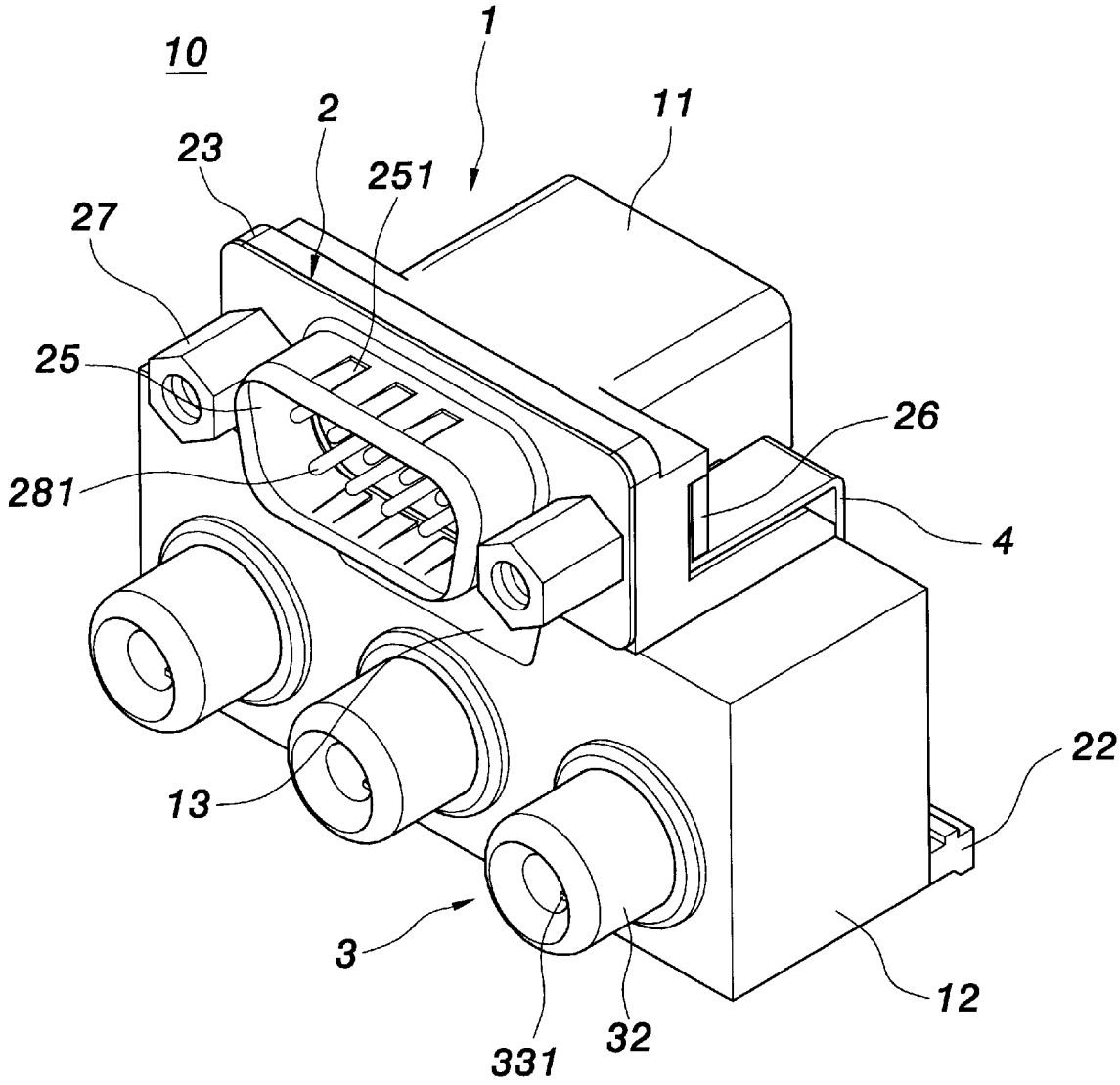
FIG. 2 is an assembled perspective view of the present invention.
Figure 3:
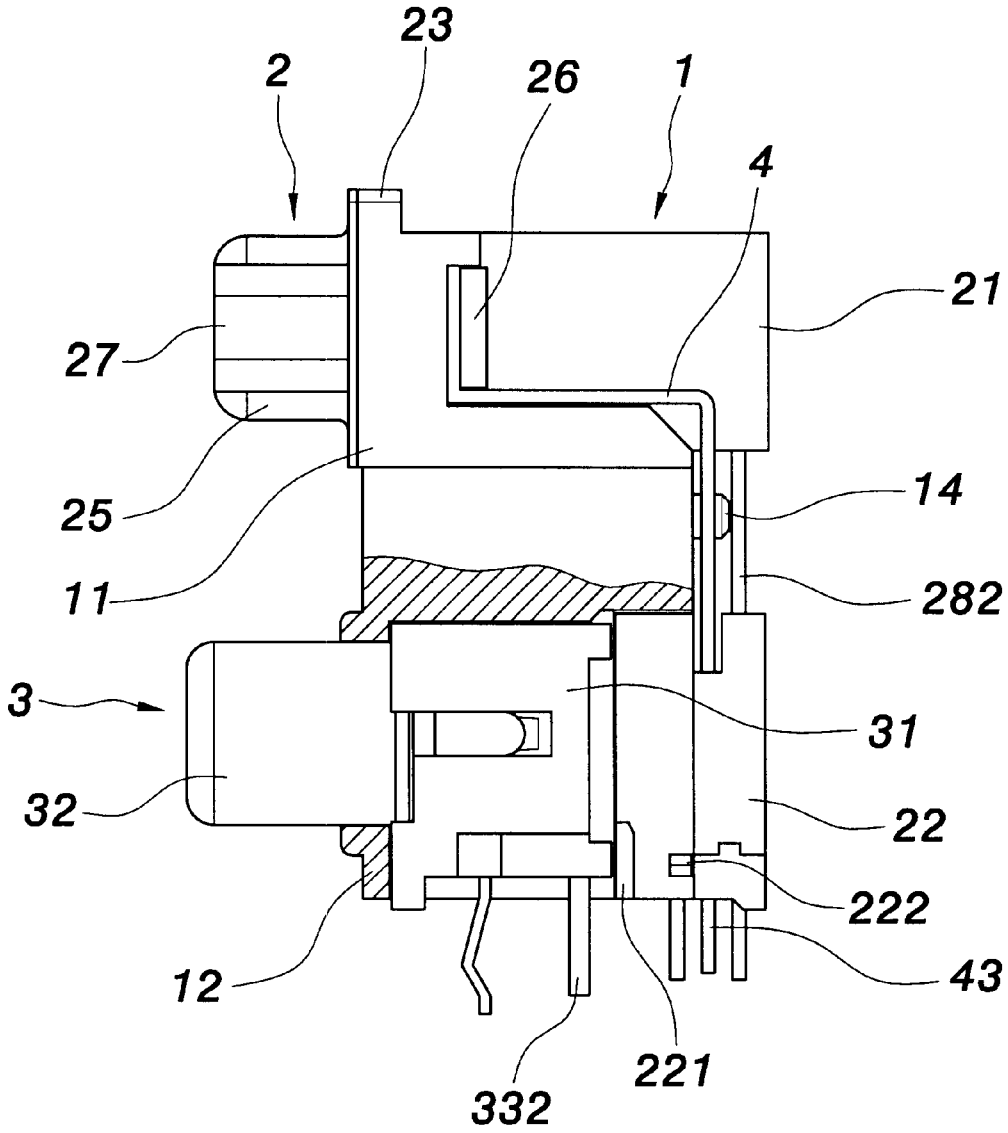
FIG. 3 is an assembled side cross-sectional view of the present invention.

As shown in FIGS. 2 and 3, an improved connector structure of the present invention is a double-layer connector 10 comprising an insulating main body 1, a D-type connector 2, an upper and a lower terminal seat 21 and 22, and an AV plug connector 3. The insulating main body 1 has a first main body 11 and a second main body 12. The first main body is at the upper layer, and is used to install the D-type connector 2. The second main body 12 is at the lower layer, and is used to install the AV plug connector 3. A hollowed portion 13 is formed between the first main body 11 and the second main body 12 to save material cost. A projective pole 14 is formed at each end at the rear side of the first main body 11.

The D-type connector 2 has a panel body 23 in front of the first main body 11 at the upper layer. A penetrated hole 24 is disposed at each side of the panel body 23. A metal shell 25 is riveted at the front side of the panel body 23. The metal shell 25 is fixed at the front side of the panel body 23 by penetrating the panel body 23 and the penetrated holes 24 at two side of the metal shell 25 with riveting elements 26 and then locking with screwing elements 27. A plurality of abutting sheets 251 are disposed at two sides above and below the metal shell 25. When a plug connector corresponding to the D-type connector 2 is inserted, the abutting sheets 251 can abut against the plug connector.

Each conductive terminal 28 of the D-type connector 2 is bent into an L shape having a transversal portion 281 and a straight portion 282. The transversal portion 281 is used as a contact end to contact a conductive terminal of the plug connector. The straight portion 282 is used as a solder end to be soldered on a printed circuit board. The transversal portion 281 of the conductive terminal 28 is embedded into the upper terminal seat 21. Retaining hooks 211 are disposed at two sides of the upper terminal seat 21. The retaining hooks 211 are used to retain the upper terminal seat 21 at the rear side of the first main body 11. The straight portion 282 of the conductive terminal 28 is embedded into the lower terminal seat 22. Embedding portions 221 and retaining hooks 222 are respectively disposed at the bottoms of two sides of the lower terminal seat 22. The embedding portions 221 and the retaining hooks 222 are used to retain the lower terminal seat at the rear side of the second main body 12.

In the best embodiment of the present invention, three abreast AV plug connectors 3 are disposed. The AV plug connector 3 has an insulating seat 31. An insertion socket 32 is integrally formed at the front side of the insulating seat 31. The insertion socket 32 has an L-shaped conductive terminal therein. The conductive terminal has a transversal portion 331 as a contact end and a straight portion as a solder end. The transversal portion 331 of the conductive terminal is in the insertion socket 32, and the straight portion 332 of the conductive terminal extends out of the insulating seat 31. The AV plug connector 3 is wholly assembled and then installed in a through hole 121 formed in the second main body 12. The insertion socket 32 protrudes out of the through hole 121.

In the present invention, a fastening element 4 can be fixedly joined at each side of the insulating main body 1 to fixedly fasten the connector 10 on a printed circuit board. The upper ends of the fastening elements 4 have joint holes 41 to match the riveting elements 26 so as to fix the two fastening elements 4 on the insulating main body 1. The fastening elements 4 have embedding holes 42 corresponding to the projective poles 14 of the insulating main body 1. The projective poles 14 are embedded into the embedding holes 42 of the fastening elements 4 so that the two fastening elements 4 can be firmly fixed on the insulating main body 1. The lower ends of the fastening elements 4 have retaining portions 43 to be fixedly retained on a printed circuit board.

Referring to FIGS. 2 and 4, when the present invention is assembled, the AV plug connector 3 is first installed in the through hole 121 of the second main body 12 with the insertion socket 32 protruding out of the through hole 121. Next, the riveting elements 26 and the screwing elements 27 are used to fix the metal shell 25 at the front side of the panel body 23 of the first main body 11. When the riveting elements 26 pass through the penetrated holes 24 on the first main body 11, they will first pass through the joint holes 41 on the fastening elements 4 to fasten the fastening elements 4 at the rear side of the insulating main body 1. Subsequently, the conductive terminals 28 of the D-type connector 2 are embedded into the upper and lower terminal seats 21 and 22. The upper terminal seat 21 is retained at the rear side of the first main body 11 via the retaining hooks 211, and the lower terminal seat 22 is retained at the rear side of the second main body 12 via the embedding portions 221 and the retaining hooks 222. The AV plug connector 3 is in front of the lower terminal seat 22. Resistance of the lower terminal seat 22 is exploited to prevent the AV plug connector 3 from leaving the insulating main body 1. A double-layer connector 10 of the present invention is thus formed, as shown in FIG. 3.

To sum up, in the present invention, a D-type connector and an AV plug connector are assembled together to facilitate insertion for use. Moreover, the whole structure is much simplified to facilitate assembly, hence greatly lowering the manufacturing and processing cost. Besides, space can be much saved to reduce the volume of the whole double-layer connector 10.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A connector structure comprising:

an insulating body having first and second connector housings integrally formed as a single piece, said first connector housing having a plurality of first channels extending therethrough and said second connector housing having a plurality of second channels extending therethrough;

a frame member mounted on a front surface of said first connector housing, said frame member being adapted to receive a connector of an electrical cable, said frame member having a plurality of fingers projecting therefrom for contacting and holding said connector;

plurality of first and second conducting terminals, each of said first and second conducting terminals being L-shaped with a horizontally directed contact portion and a vertically directed tail portion, said contact portions of said first and second conducting terminals being received within said first and second channels, respectively;

an upper terminal seat mounted to a rear portion of said first connector housing, said upper terminal seat having a plurality of upper terminal grooves formed therein, said upper terminal grooves receiving adjacent sections of said contact portions and said tail portions of said first and second conducting terminals therein for holding and protecting said first and second conducting terminals adjacent said first connector housing, and, a seat member secured to said a rear side of said second connector housing, said seat member having a plurality of first and second terminal channels extending therethrough, said tail portions of said first and second conducting terminals being received by said first and second terminal channels, respectively.

2. The connector structure as recited in claim 1, wherein said first connector housing is adapted to receive a D-type cable connector.

3. The connector structure as recited in claim 1, wherein said second connector housing is adapted to receive an audio-video type cable.

4. The connector structure as recited in claim 1, wherein said insulating body has a plurality of fastening members fixedly secured thereto for fastening said insulating body to a printed circuit board.

* * * * *